US007373973B2

(12) United States Patent
Smith et al.

(10) Patent No.: US 7,373,973 B2
(45) Date of Patent: May 20, 2008

(54) PACKER ELEMENT RETAINING SYSTEM

(75) Inventors: Donald Smith, Duncan, OK (US); Donny Winslow, Duncan, OK (US); Mike Sutton, Katy, TX (US); Tracy Martin, Sring, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/531,584

(22) Filed: Sep. 13, 2006

(65) Prior Publication Data

US 2008/0060821 A1 Mar. 13, 2008

(51) Int. Cl.
*E21B 33/12* (2006.01)

(52) U.S. Cl. ..... 166/134; 166/387; 277/342; 277/611

(58) Field of Classification Search ..... 166/118, 166/134, 386, 387, 192, 138, 195; 277/342, 277/611, 946
See application file for complete search history.

(56) References Cited

U.S. PATENT DOCUMENTS

| | | | | |
|---|---|---|---|---|
| 2,368,428 | A | | 1/1945 | Saurenman |
| 3,154,145 | A | | 10/1964 | Brown |
| 3,239,008 | A | | 3/1966 | Leutwyler |
| 3,951,211 | A | | 4/1976 | Ellis |
| 4,285,458 | A | | 8/1981 | Slavens |
| 4,288,082 | A | | 9/1981 | Setterberg, Jr. |
| 4,516,634 | A | | 5/1985 | Pitts |
| 4,682,724 | A | | 7/1987 | Hahn |
| 4,708,202 | A | | 11/1987 | Sukup et al. |
| 4,753,444 | A | | 6/1988 | Jackson et al. |
| 4,756,364 | A | | 7/1988 | Christensen et al. |
| 4,794,989 | A | | 1/1989 | Mills |
| 4,968,184 | A | | 11/1990 | Reid |
| 5,044,434 | A | | 9/1991 | Burns, Sr. et al. |
| 5,103,904 | A | * | 4/1992 | Luke et al. ..... 166/195 |
| 5,224,540 | A | | 7/1993 | Streich et al. |
| 5,271,468 | A | | 12/1993 | Streich et al. |
| 5,311,938 | A | | 5/1994 | Hendrickson et al. |
| 5,343,954 | A | | 9/1994 | Bohlen et al. |
| 5,390,737 | A | | 2/1995 | Jacobi et al. |
| 5,404,956 | A | | 4/1995 | Bohlen et al. |
| 5,433,269 | A | | 7/1995 | Hendrickson |
| 5,540,279 | A | | 7/1996 | Branch et al. |
| 5,603,511 | A | | 2/1997 | Keyser, Jr. et al. |
| 5,676,384 | A | * | 10/1997 | Culpepper ..... 277/342 |
| 5,701,954 | A | | 12/1997 | Kilgore et al. |
| 5,701,959 | A | | 12/1997 | Hushbeck et al. |

(Continued)

*Primary Examiner*—Jennifer H Gay
*Assistant Examiner*—Daniel P Stephenson
(74) *Attorney, Agent, or Firm*—John W. Wustenberg; Conley Rose, P.C.

(57) ABSTRACT

A bridge plug having a segmented backup shoe, and at least one split cone extrusion limiter, the extrusion limiter comprising a two part conical retainer positioned between packer elements and the segmented backup shoe to block packer element extrusion though spaces between backup shoe segments. In one embodiment, two split cone extrusion limiters are used together and positioned so that each split cone extrusion limiter covers gaps in the other extrusion limiter and together the two split cone extrusion limiters block packer element extrusion though gaps between backup shoe segments regardless of their orientation relative to the segmented backup shoe. In one embodiment, a solid retaining ring is positioned between a split retaining cone extrusion limiter and a packer element and resists extrusion of packer elements into spaces in the split cone extrusion limiter or limiters.

22 Claims, 8 Drawing Sheets

U.S. PATENT DOCUMENTS

| | | | | |
|---|---|---|---|---|
| 5,720,343 | A | 2/1998 | Kilgore et al. | |
| 5,857,520 | A | 1/1999 | Mullen et al. | |
| 5,904,354 | A | 5/1999 | Collins | |
| 5,944,102 | A | 8/1999 | Kilgore et al. | |
| 6,102,117 | A | 8/2000 | Swor et al. | |
| 6,112,811 | A | 9/2000 | Kilgore et al. | |
| 6,220,349 | B1 | 4/2001 | Vargus et al. | |
| 6,302,217 | B1 | 10/2001 | Kilgore et al. | |
| 6,318,460 | B1 | 11/2001 | Swor et al. | |
| 6,394,180 | B1 | 5/2002 | Berscheidt et al. | |
| 6,491,116 | B2 | 12/2002 | Berscheidt et al. | |
| 6,695,050 | B2 | 2/2004 | Winslow et al. | |
| 6,695,051 | B2 | 2/2004 | Smith et al. | |
| 6,793,022 | B2 * | 9/2004 | Vick et al. | 166/382 |
| 6,827,150 | B2 | 12/2004 | Luke | |
| 2003/0226660 | A1 * | 12/2003 | Winslow et al. | 166/118 |
| 2005/0173126 | A1 | 8/2005 | Starr et al. | |
| 2006/0021748 | A1 | 2/2006 | Swor et al. | |
| 2006/0232019 | A1 * | 10/2006 | Garrison et al. | 277/611 |
| 2006/0289173 | A1 * | 12/2006 | Conaway et al. | 166/387 |

* cited by examiner

PACKER ELEMENT RETAINING SYSTEM

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates to packer and bridge plug type tools used in wellbores and more particularly to a retainer system which resists extrusion of packer elements when exposed to borehole conditions, especially high pressure and high temperature.

BACKGROUND OF THE INVENTION

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in a well. Downhole tools referred to as packers and bridge plugs are designed for these general purposes and are well known in the art of producing oil and gas.

When it is desired to remove many of these downhole tools from a wellbore, it is frequently simpler and less expensive to mill or drill them out rather than to implement a complex retrieving operation. In milling, a milling cutter is used to grind the packer or plug, for example, or at least the outer components thereof, out of the wellbore. In drilling, a drill bit is used to cut and grind up the components of the downhole tool to remove it from the wellbore. This is a much faster operation than milling, but requires the tool to be made out of materials which can be accommodated by the drill bit. To facilitate removal of packer type tools by milling or drilling, packers and bridge plugs have been made, to the extent practical, of non-metallic materials such as engineering grade plastics and composites.

Non-metallic backup shoes have been used in such tools to support the ends of packer elements as they are expanded into contact with a borehole wall. The shoes are typically segmented and, when the tool is set in a well, spaces between the expanded segments have been found to allow undesirable extrusion of the packer elements, at least in high pressure and high temperature wells. This tendency to extrude effectively sets the pressure and temperature limits for any given tool. Numerous improvements have been made in efforts to prevent the extrusion of the packer elements, and while some have been effective to some extent, they have been complicated and expensive.

SUMMARY OF THE INVENTION

An embodiment includes a bridge plug having a segmented backup shoe, and at least one split cone extrusion limiter, the extrusion limiter comprising a two part conical retainer positioned between packer elements and the segmented backup shoe to block packer element extrusion though spaces between backup shoe segments.

In one embodiment, two split cone extrusion limiter are used together and positioned so that each split cone extrusion limiter covers gaps in the other extrusion limiter and together the two split cone extrusion limiters block packer element extrusion though spaces between backup shoe segments regardless of their orientation relative to the segmented backup shoe.

In one embodiment, a solid retaining ring is positioned between a split retaining cone extrusion limiter and a packer element and resists extrusion of packer elements into spaces in the split cone extrusion limiter or limiters.

DETAILED DESCRIPTION OF THE PREFERRED EMBODIMENTS

Figure 1:
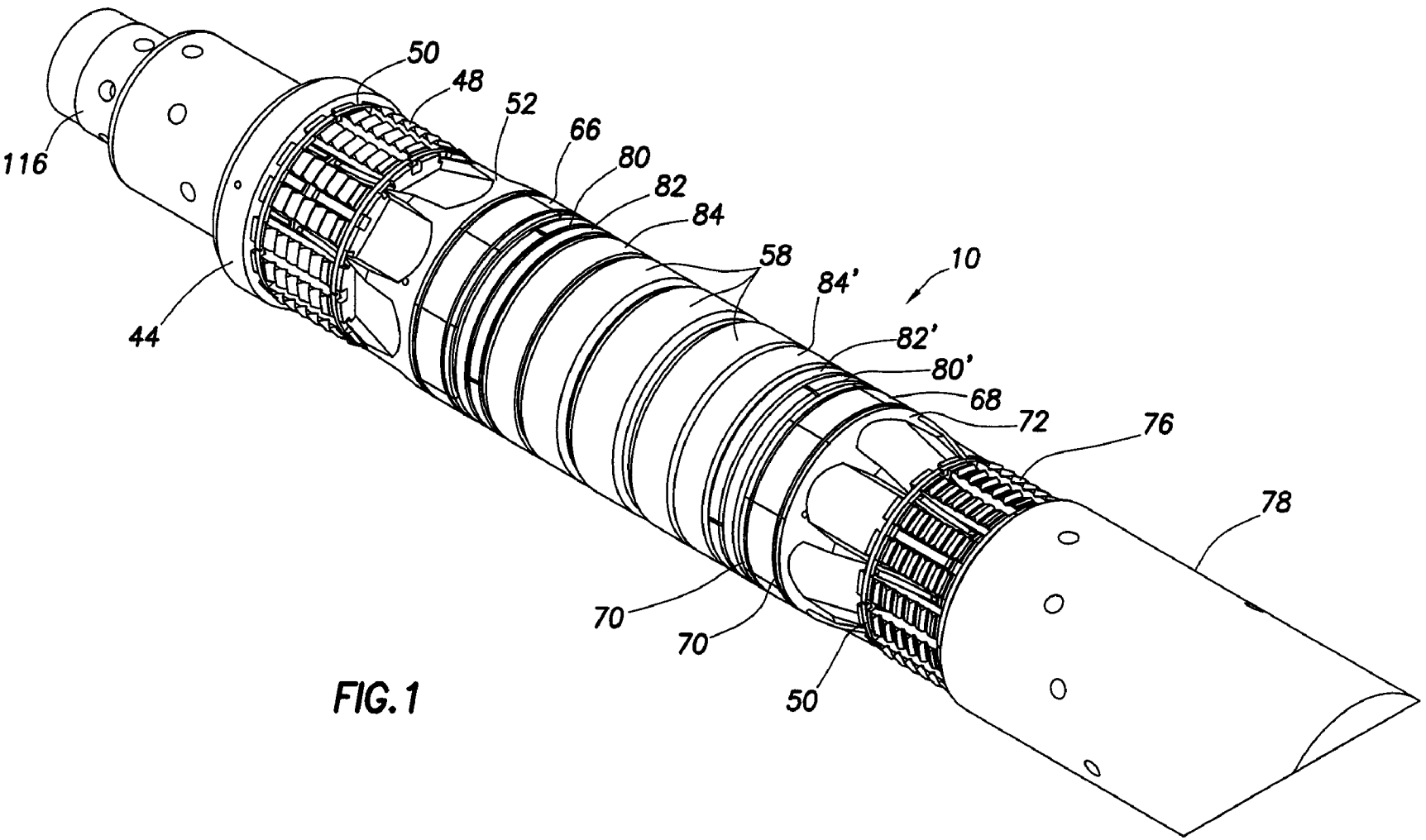
FIG. 1 is a perspective view of a bridge plug tool in its run in condition according to an embodiment.
Figure 2A:
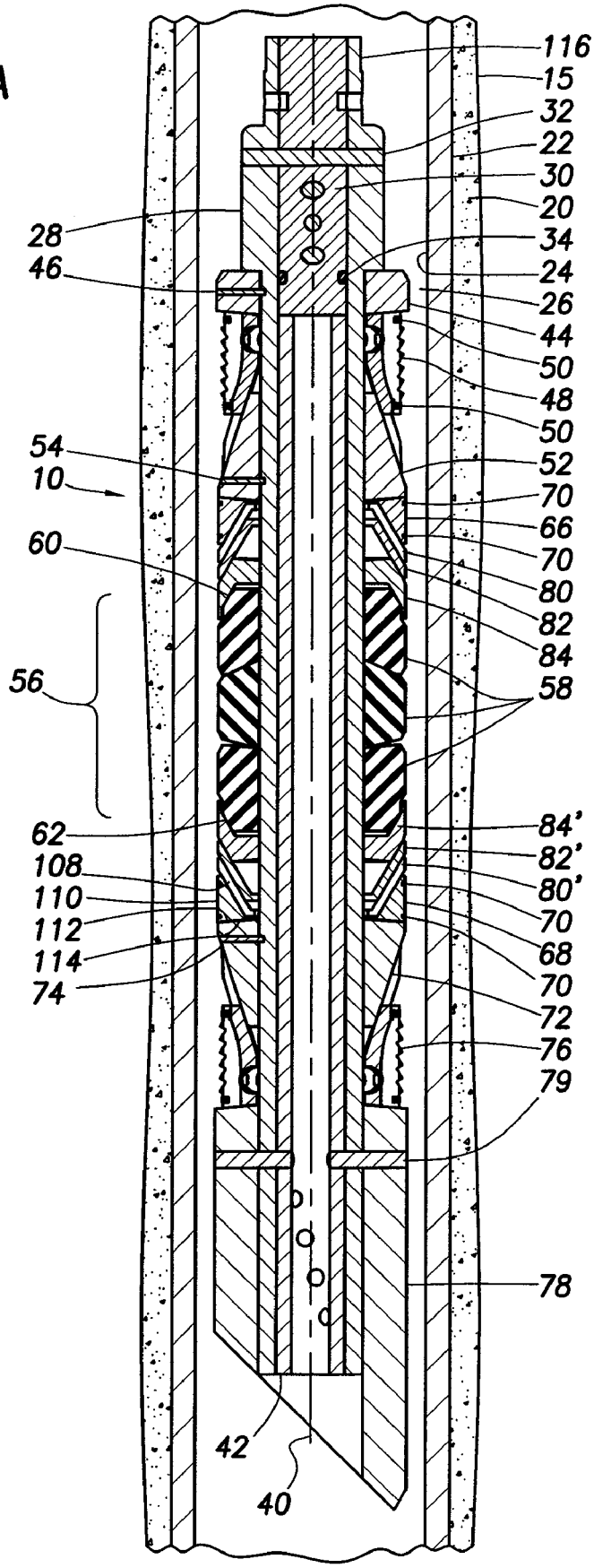
FIG. 2A is a cross sectional view of the bridge plug tool of FIG. 1 in its run in condition.
Figure 2B:
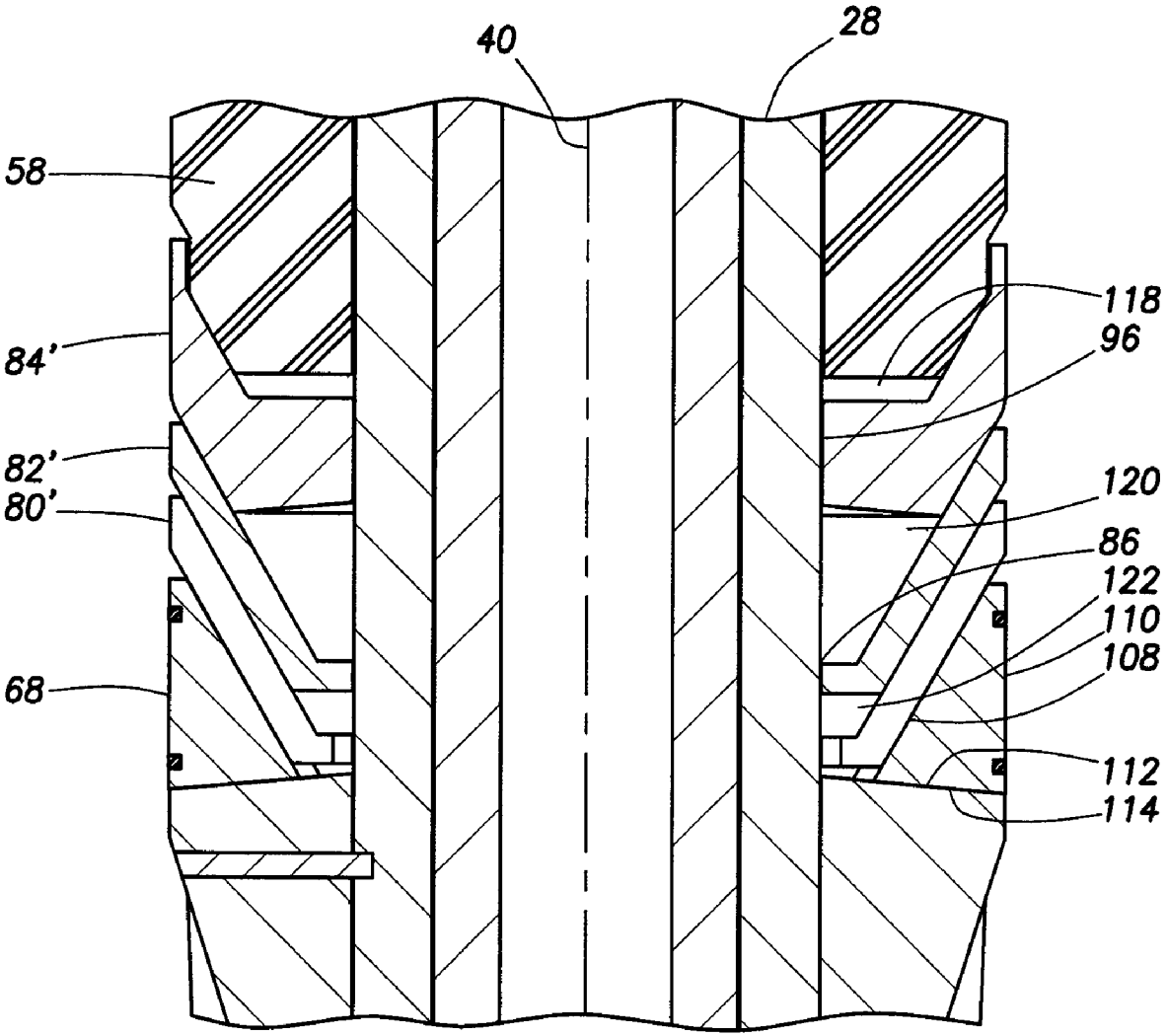
FIG. 2B is a cross sectional view of a portion of the bridge plug tool of FIG. 1 in its run in condition showing details of extrusion limiters.

FIG. 1 is a perspective view of a bridge plug embodiment 10 in an unset or run in condition. In FIGS. 2A and 2B, the bridge plug 10 is shown in the unset condition in a well 15. The well 15 may be either a cased completion with a casing 22 cemented therein by cement 20 as shown in FIG. 2A or an openhole completion. Bridge plug 10 is shown in set position in FIGS. 3A and 3B. Casing 22 has an inner surface 24. An annulus 26 is defined between casing 22 and downhole tool 10. Downhole tool 10 has a packer mandrel 28, and is referred to as a bridge plug due to a plug 30 being pinned within packer mandrel 28 by radially oriented pins 32. Plug 30 has a seal means 34 located between plug 30 and the internal diameter of packer mandrel 28 to prevent fluid flow therebetween. The overall downhole tool 10 structure, however, is adaptable to tools referred to as packers, which typically have at least one means for allowing fluid communication through the tool. Packers may therefore allow for the controlling of fluid passage through the tool by way of one or more valve mechanisms which may be integral to the packer body or which may be externally attached to the packer body. Such valve mechanisms are not shown in the drawings of the present document. Packer tools may be deployed in wellbores having casings or other such annular structure or geometry in which the tool may be set.

Packer mandrel 28 has a longitudinal central axis, or axial centerline 40. An inner tube 42 is disposed in, and is pinned to, packer mandrel 28 to help support plug 30.

Tool 10 includes a spacer ring 44 which is preferably secured to packer mandrel 28 by shear pins 46. Spacer ring 44 provides an abutment which serves to axially retain slip segments 48 which are positioned circumferentially about packer mandrel 28. Slip retaining bands 50 serve to radially retain slip segments 48 in an initial circumferential position about packer mandrel 28 and slip wedge 52. Bands 50 may be made of a steel wire, a plastic material, or a composite material having the requisite characteristics of having sufficient strength to hold the slip segments 48 in place prior to actually setting the tool 10 and to be easily drillable when the tool 10 is to be removed from the wellbore 15. Preferably, bands 50 are inexpensive and easily installed about slip segments 48. Slip wedge 52 is initially positioned in a slidable relationship to, and partially underneath, slip segments 48 as shown in FIGS. 1 and 2A. Slip wedge 52 is shown pinned into place by shear pins 54.

Figure 3A:
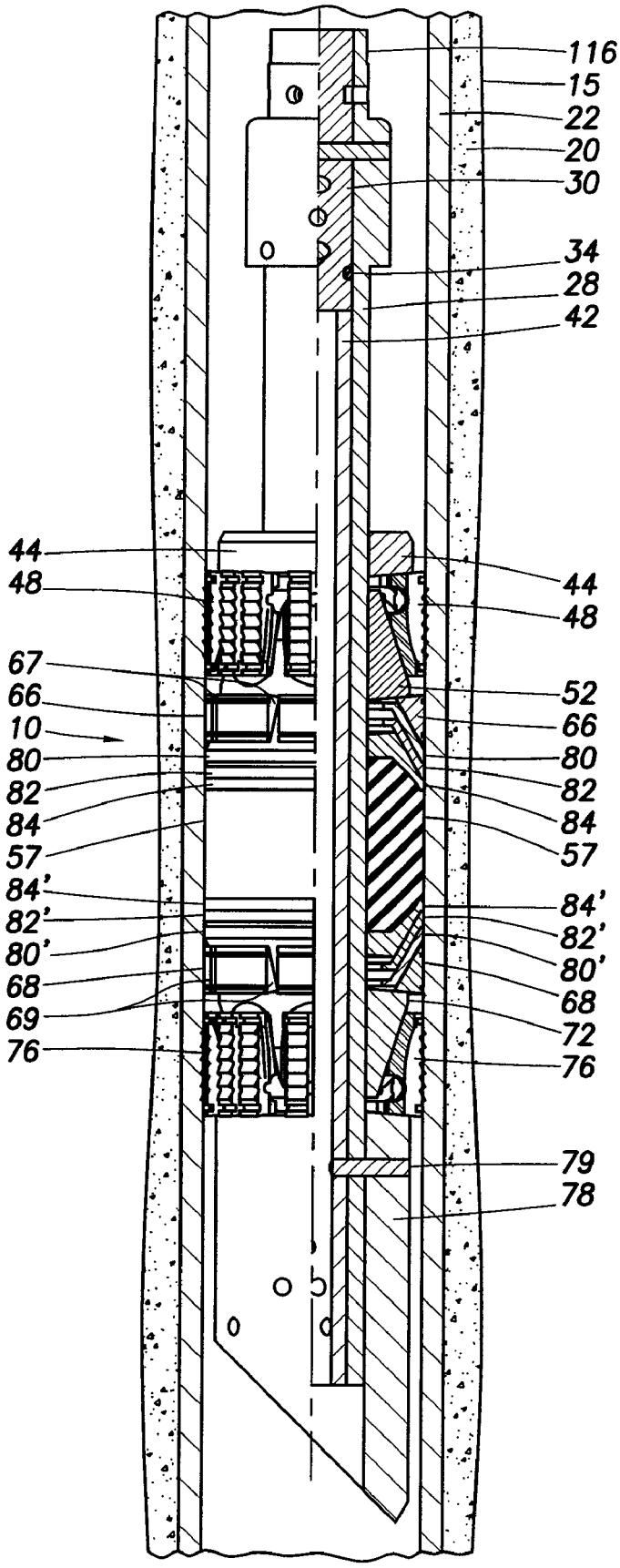
FIG. 3A is an illustration of the bridge plug tool of FIGS. 1, 2 and 2A in its set condition.

Located below slip wedge 52 is a packer element assembly 56, which includes at least one packer element 57 as shown in FIG. 3A or as shown in FIG. 2A may include a plurality of expandable packer elements 58 positioned about packer mandrel 28. Packer element assembly 56 has an unset position shown in FIGS. 1 and 2A and a set position shown in FIG. 3A. Packer element assembly 56 has upper end 60 and lower end 62.

At the lowermost portion of tool 10 is an angled portion, referred to as mule shoe 78, secured to packer mandrel 28 by pin 79. Just above mule shoe 78 is located slip segments 76. Just above slip segments 76 is located slip wedge 72, secured to packer mandrel 28 by shear pin 74. Slip wedge 72 and slip segments 76 may be identical to slip wedge 52 and slip segments 48. The lowermost portion of tool 10 need not be mule shoe 78, but may be any type of section which will serve to prevent downward movement of slips 76 and terminate the structure of the tool 10 or serve to connect the tool 10 with other tools, a valve or tubing, etc. It will be appreciated by those in the art that shear pins 46, 54, and 74, if used at all, are pre-selected to have shear strengths that allow for the tool 10 to be set and deployed and to withstand the forces expected to be encountered in the wellbore 20 during the operation of the tool 10.

Located just below upper slip wedge 52 is a segmented backup shoe 66. Located just above lower slip wedge 72 is a segmented backup shoe 68. As seen best in FIG. 1, the backup shoes 66 and 68 comprise a plurality of segments, e.g. eight, in this embodiment. The multiple segments of each backup shoe 66, 68 are held together on mandrel 28 by retaining bands 70 carried in grooves on the outer surface of the backup shoe segments. The bands 70 may be equivalent to the bands 50 used to retain slips 48 in run in position.

Figure 3B:
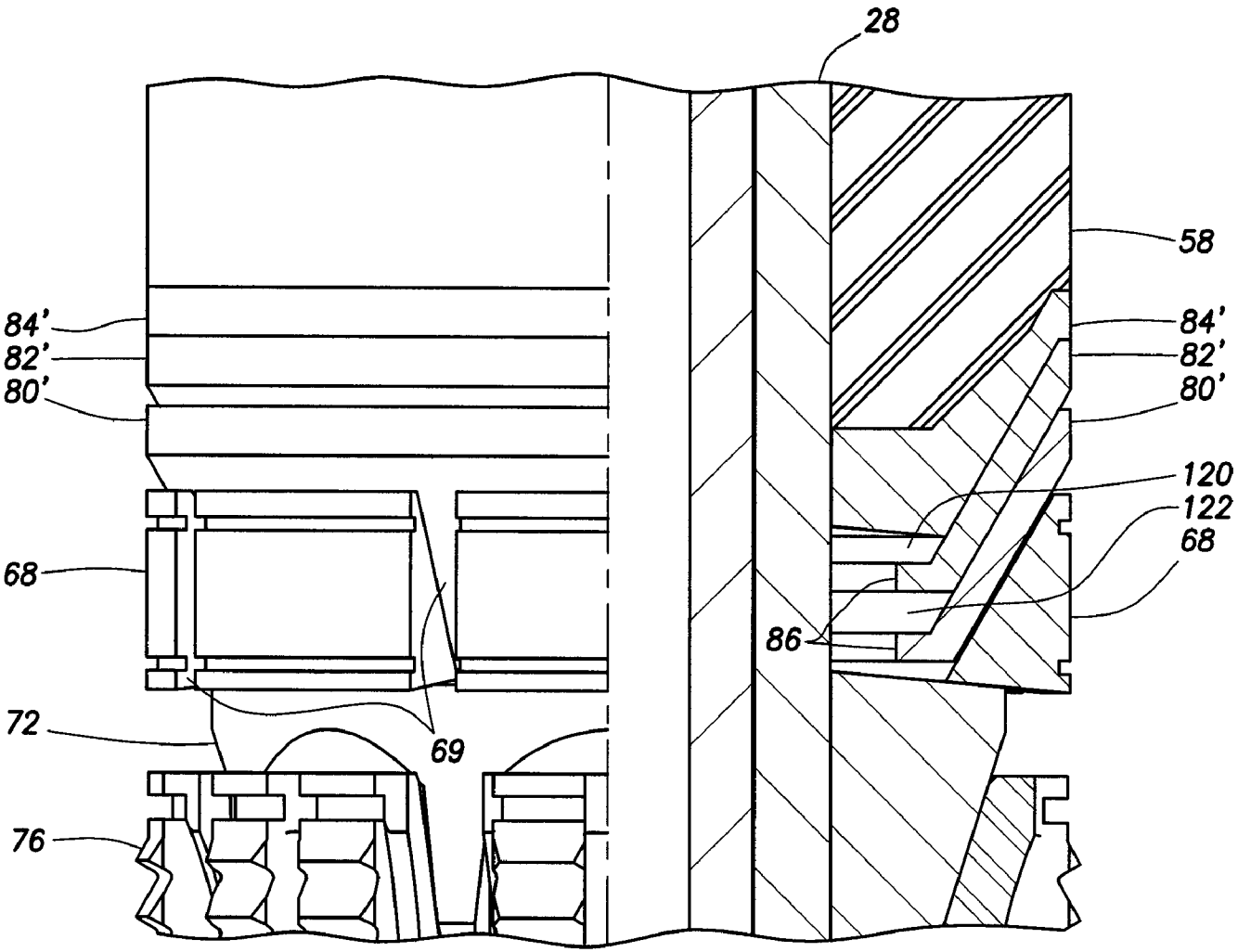
FIG. 3B is an illustration of a portion the bridge plug tool of FIGS. 1, 2 and 2A in its set condition showing details of extrusion limiters.

The elements of the tool 10 described to this point of the disclosure may be considered equivalent to elements of known drillable bridge plugs and/or packers. The known tools have been limited in terms of pressure and temperature capabilities by extrusion of packer elements 57, 58 when set in a wellbore. During setting, as shown in FIGS. 3A and 3B, the segments of segmented backup shoes 66, 68 expand radially generating gaps 67, 69 respectively between the segments. At sufficiently high pressure and temperature conditions, the elastomer normally used to form the packer elements 57, 58 tends to extrude through the gaps 67, 69 leading to damage to the elements 57, 58 and leakage of well fluids past the tool 10. The present disclosure provides several embodiments that resist such element extrusion and have substantially increased the pressure rating of the tool 10 at high temperature while being simple, inexpensive and easy to build and install.

With reference to FIGS. 1-3B, an embodiment includes three extrusion limiting elements positioned between the upper backup shoe 66 and the upper end 60 of the packer elements, and three extrusion limiting elements positioned between the lower backup shoe 68 and the lower end 62 of the packer elements 57, 58. Two split cone extrusion limiters 80 and 82 are stacked together and positioned adjacent the upper segmented backup shoe 66. Between split cone 82 and the upper end 60 of packer elements 58 is positioned a solid retaining ring 84. At the lower end 62 of the packer elements 58 are located identical split cone extrusion limiters 80' and 82' and a solid retaining ring 84'. In alternative embodiments only one of the split cone extrusion limiters 80, 82 is used at each end of the packer elements 57, 58 or both split cone extrusion limiters are used without the solid retaining ring 84. However, it is preferred to use both split cone extrusion limiters 80, 82 and the solid retaining ring 84 at both ends of the packer elements 57, 58.

Figure 4C:
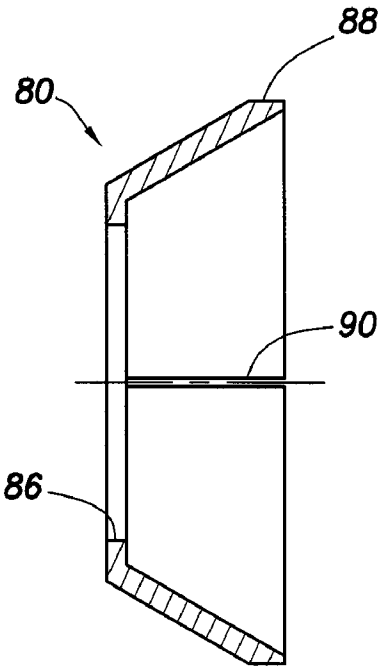
FIGS. 4A, 4B and 4C are side, plan and cross sectional illustrations of a split cone extrusion limiter according to an embodiment.
Figure 4B:
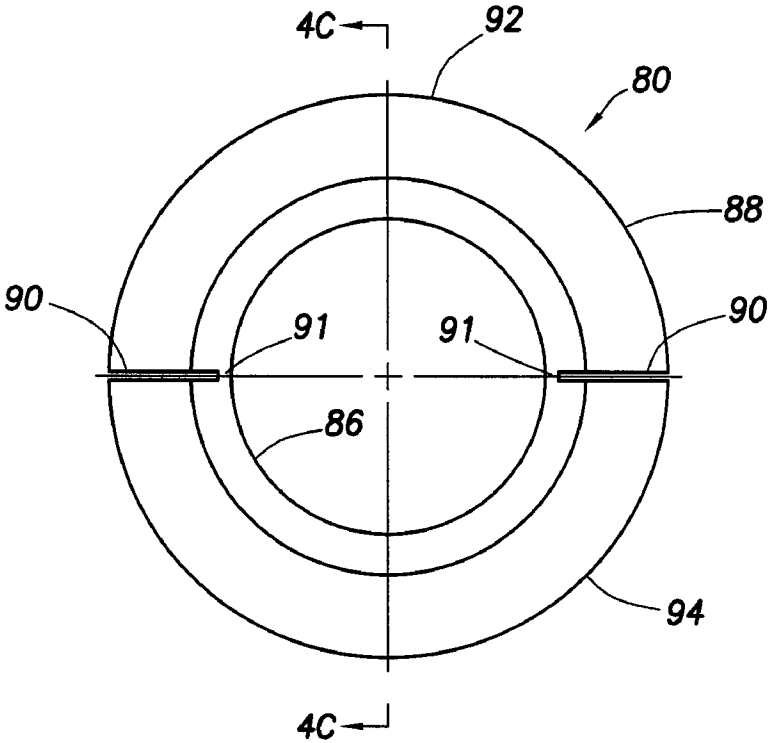
Figure 4A:
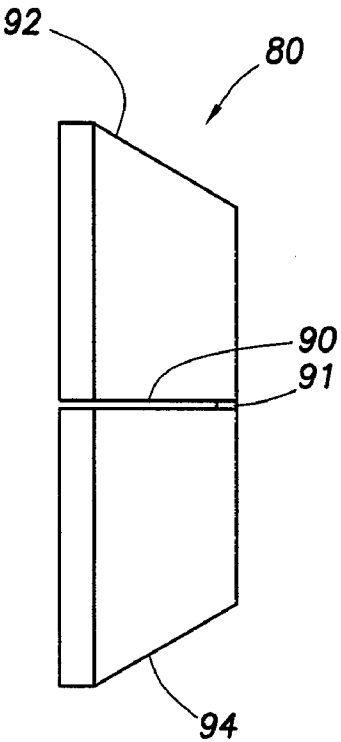

FIGS. 4A, 4B, 4C illustrate more details of the split cone extrusion limiter 80. Extrusion limiter 82 may be identical to extrusion limiter 80. The extrusion limiter 80 may be essentially a simple section of a hollow cone having an inner diameter at 86 sized to fit onto the mandrel 28 and an outer diameter at 88 corresponding to the outer diameter of tool 10 in its run in condition shown in FIGS. 1 and 2. The extrusion limiter 80 is preferably made of a non-metallic material such as a fiber-reinforced polymer composite. The composite is preferably reinforced with E-glass glass fibers. Such composites are commonly referred to as fiberglass. However the extrusion limiter 80 may be made of other engineering plastics if desired. Such materials have high strength and are flexible.

The split cone extrusion limiter 80 may be conveniently made by forming a radially continuous cone equivalent to a funnel and then cutting two gaps 90 to form two separate half cones 92, 94. In this embodiment, the gaps 90 are not cut completely through to the inner diameter 86 of the split cone 80. Small amounts of material remain at the inner diameter 86 at each gap 90 forming releasable couplings 91 between the half cones 92, 94. By leaving the half cones 92, 94 weakly attached, assembly of the tool 10 is facilitated. Upon setting of the tool 10 in a wellbore, the releasable couplings 91 break and the half cones 92, 94 separate and perform their extrusion limiting function as separate elements. Alternatively, the cone halves 92, 94 may be fabricated separately and each half may be identical to the other. Bands, like bands 50 and 70 could then be used to assemble two half cones onto the mandrel as shown in FIGS. 1 and 2A, for running the bridge plug 10 into a well. In another alternative, the bands 70 and segmented backup shoes 66 and 68 may hold the separate half cones 92, 94 in run in position once the bridge plug is assembled as shown in FIG. 2A.

Figure 5:
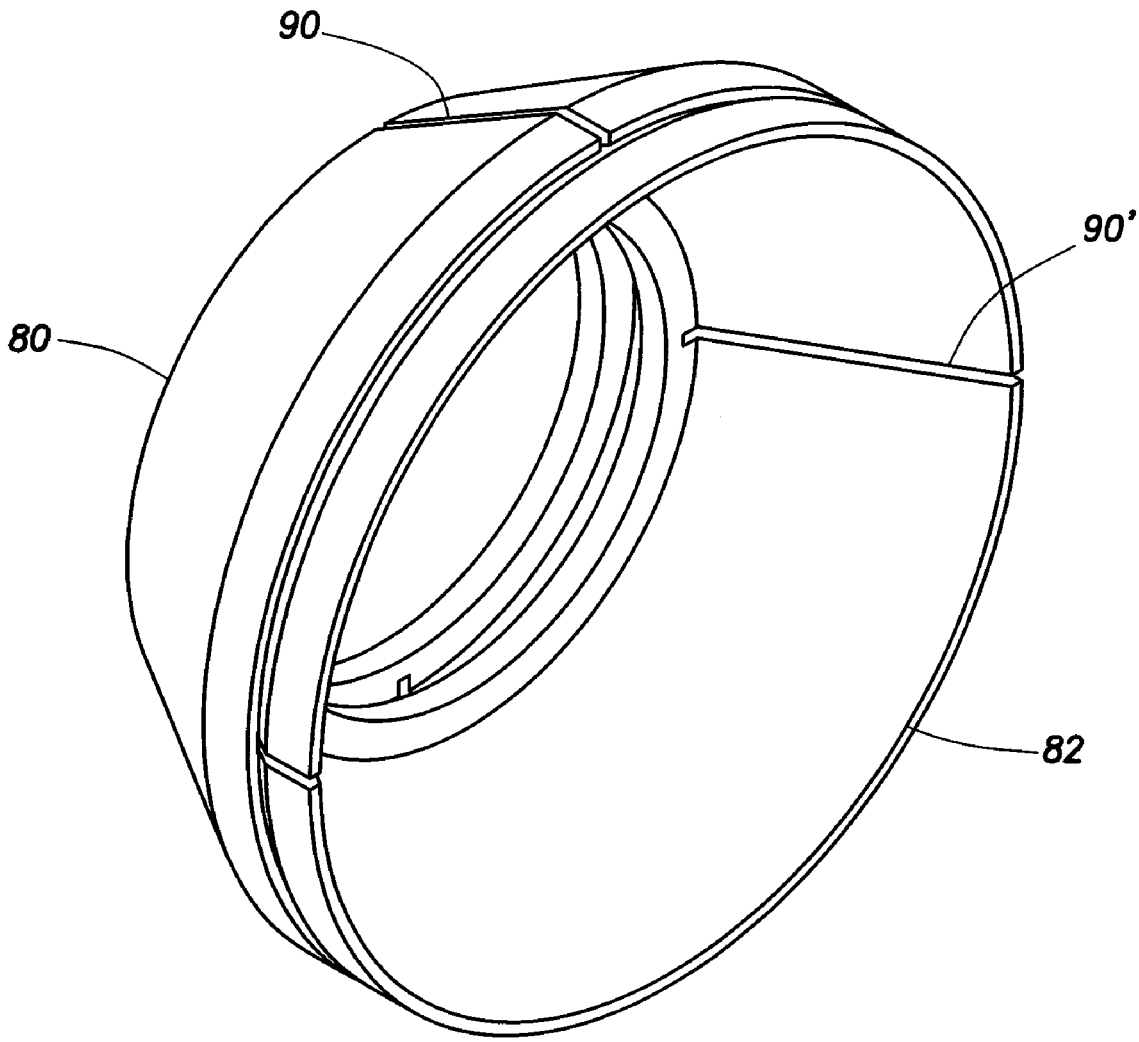
FIG. 5 is a perspective view of two split cone extrusion limiters stacked for assembly into the tool of FIGS. 1 and 2.

FIG. 5 illustrates the assembly of two split cone extrusion limiters 80 and 82 in preparation for assembly onto the mandrel 28. The gaps 90 of extrusion limiter 80 are intentionally misaligned with the gaps 90' of extrusion limiter 82 and preferably positioned about ninety degrees from the position of gaps 90' of extrusion limiter 82. Each limiter 80, 82 therefore resists extrusion of packer elements 58 through gaps 90, 90' of the other limiter. The two limiters 80, 82 together form a continuous extrusion limiting cone resisting extrusion of the packer elements 57, 58 through gaps 67, 69 between segments of the segmented backup shoes 66, 68.

Figure 7:
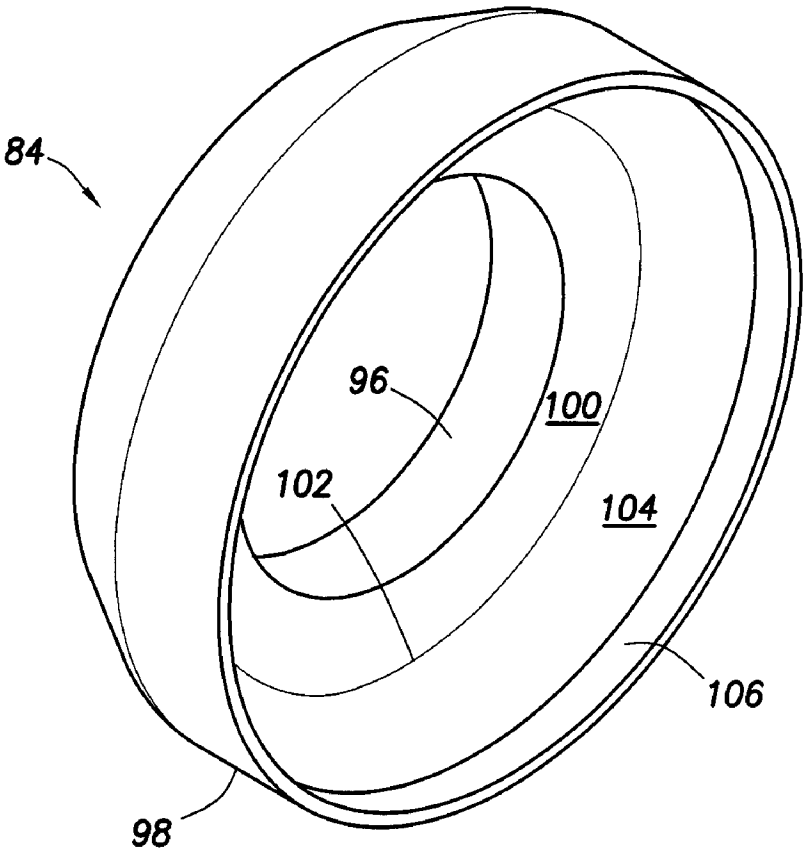
FIG. 7 is a perspective view of the solid retaining ring.
Figure 6:
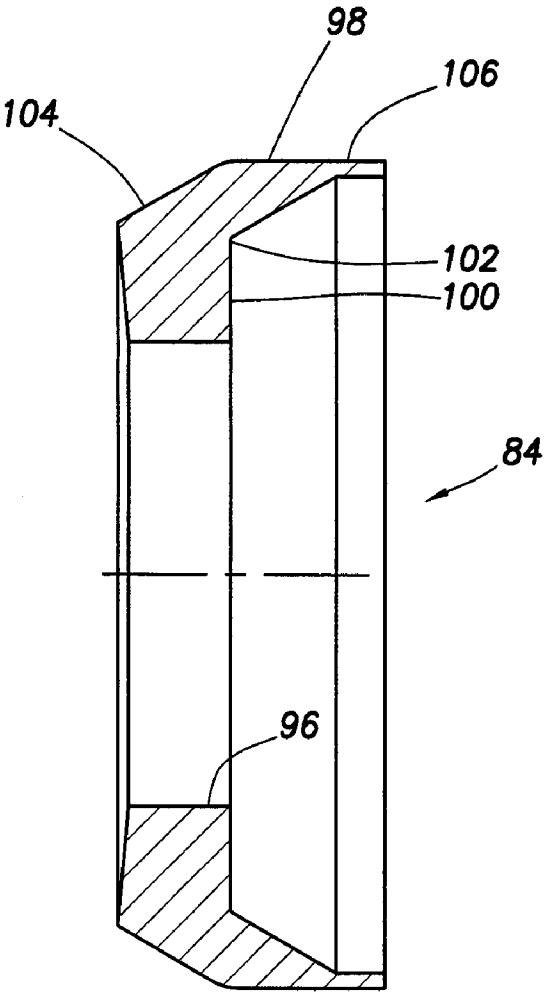
FIG. 6 is a cross sectional illustration of a solid retaining ring.

FIGS. 6 and 7 are illustrations of the solid retaining rings 84, 84'. Retaining rings 84, 84' are referred to herein as solid because they are not segmented like backup shoes 66, 68 and are not split like the split cone extrusion limiters 80, 82. The retaining rings 84, 84' are continuous rings having an inner diameter 96 sized to fit onto the mandrel 28 and an outer diameter 98 about equal to the run in diameter of the bridge plug 10. The retaining rings 84, 84' are thicker at the inner diameter and taper to a thin edge at the outer diameter. The retaining rings 84, 84' are preferably made of a material that can be expanded, but does not extrude as easily as the packer elements 57, 58. A suitable material is polytetrafluoroethylene, PTFE.

Retaining rings 84, 84' in this embodiment have three sections each having different shape and thickness. A first inner section 100, extending from the inner diameter 96 to an intermediate diameter 102 has an essentially flat disk shape and is the thickest section. A second section 104 extending from the intermediate diameter 102 to the full run in diameter 98 has a conical shape and is thinner than the first section. The third section 106 is essentially cylindrical, extends from the second section 104, has an outer diameter 98 equal to the run in diameter of tool 10, and is thinner than the second section 104. The differences in thickness of the three sections facilitate expansion and flexing of the second and third sections as the tool 10 is set in a borehole.

As seen best in FIGS. 2A and 2B, the conical second section 104 of retainers 84, 84' have about the same angle relative to the axis 40 of tool 10 as do the ends 60, 62 of packer elements 57, 58, the split cone extrusion limiters 80, 82 and inner surfaces 108 of the segmented backup shoes 66, 68. In an embodiment, this angle may be about thirty degrees relative to the central axis 40. The cross section of backup shoes 66, 68 is essentially triangular including the inner surfaces 108 and an outer surface 110 which is essentially cylindrical and in the run in condition has about the same diameter as other elements of the tool 10. The shoes 66, 58 have a third side 112 which abuts a slightly slanted surface 114 of the slip wedges 52, 72. The slant of third side 112 and the slip wedge surface 114 is preferably about five degrees from perpendicular to the central axis 40.

With reference to FIGS. 1, 2A, 2B, 3A and 3B, operation of the tool 10 will be described. The tool 10 in the FIG. 2A, 2B run in condition is typically lowered into, i.e. run in, a well by means of a work string of tubing sections or coiled tubing attached to the upper end 116 of the tool. A setting tool, not shown but well known in the art, is part of the work string. When the tool 10 is at a desired depth in the well, the setting tool is actuated and it drives the spacer ring 44 from its run in position, FIG. 2A, to the set position shown in FIG. 3A. As this is done, the shear pins 46, 54, and 74 are sheared. The slips 48, 76 slide up the slip wedges 52, 72 and are pressed into gripping contact with the casing 22, or borehole wall 15 if the well is not cased.

The force applied to set the wedges 52, 72 is also applied to the packer elements 57, 58 so that they expand into sealing contact with the casing 22, or borehole wall 15 if the well is not cased. The forces are also applied to the backup shoes 66, 68, the split cone extrusion limiters 80, 82, 80', 82' and to the solid retaining rings 84, 84'. Due to the slanted surfaces of these parts, the backup shoes 66, 68 expand radially and the gaps 67, 69 between the segments open, as seen best in FIGS. 3A, 3B. The split cone extrusion limiters 80, 82, 80', 82' expand radially away from the mandrel 28 with the backup shoes 66, 68 and resist extrusion of the elements 57, 58 through the gaps 67, 69. If the split cone extrusion limiters 80, 82, 80', 82' were made according to FIGS. 4 and 5, the small releasable couplings 91 are broken so that each half cone portion 92, 94 expands radially away from its corresponding half cone portion. However, the angle of the cones relative to the axis 40 of the tool 10 is essentially unchanged from the run in condition to the set condition.

Since the retaining rings 84, 84' are not split or segmented, they do not expand radially in the same way as the backup shoes 66, 68 and the split cone extrusion limiters 80, 82, 80', 82'. However, the tapered shape of the retaining rings 84, 84' allows the second section 104 and third section 106 of the retaining rings to expand to the set diameter of tool 10 by stretching and bending. As the setting process occurs and the retaining rings 84, 84' expand and bend, the pairs of split cone extrusion limiters 82, 82' effectively slide up the outer surface of the retaining rings 84, 84', providing support to the retaining rings 84, 84' and limiting expansion thereof. The pairs of split cone extrusion limiters 80, 80' expand radially away from mandrel 28 with the pairs of split cone extrusion limiters 82, 82'. At the same time, the retaining rings 84, 84' flow into and seal the gaps 90' (FIG. 5) in the split cone extrusion limiters 82, 82'. If this flow does not occur during setting of the tool 10, it may occur when the tool is exposed to high pressure differential in the well 15. The retaining rings 84, 84' are preferably made of PTFE or an equivalent material that can extrude to some extent, but not to the extent that elastomers used for packer elements 57, 58 do at high temperature and high pressure.

The exploded, or blown up, views of FIGS. 2B and 3B show details of the setting process for the tool 10. In the run in condition of FIG. 2B, an axial space 118 is provided between the packer element 58 and the first section 100 of the retaining ring 84'. An axial space 120 is provided between the first section 100 of the retaining ring 84' and the split cone extrusion limiter 82'. An axial space 122 is provided between the split cone extrusion limiter 82' and the split cone extrusion limiter 80'. The inner diameter 96 of retaining ring 84 and inner diameters 86 of split cone extrusion limiters 80' and 82' are all near or in contact with the mandrel 28.

In the set condition of FIG. 3B, it can be seen that the space 118 has been filled with a portion of the packer element 58 as the packer element 58 and retaining ring 84' expanded to the set diameter. The space 120 has been reduced as the split cone extrusion limiter 82' expanded radially and effectively slid up the outer surface of the retaining ring 84'. Split cone extrusion limiter 80' has also expanded radially and remained in contact with the split cone extrusion limiter 82' and the backup shoe 68. The inner diameters 86 of the split cone extrusion limiters 80' and 82' are now radially displaced from the mandrel 28. The inner diameter 96 of retaining ring 84' remains essentially in contact with the mandrel 28, and its outer diameter 106 has expanded by expansion and bending of the retaining ring 84'.

Segmented backup shoes 66, 68 may be made of a phenolic material available from General Plastics & Rubber Company, Inc., 5727 Ledbetter, Houston, Tex. 77087-4095, which includes a direction-specific laminate material referred to as GP-B35F6E21K. Alternatively, structural phenolics available from commercial suppliers may be used. Split cone extrusion limiters 80, 84, 80', 84' may be made of a composite material available from General Plastics & Rubber Company, Inc., 5727 Ledbetter, Houston, Tex. 77087-4095. A particularly suitable material includes a direction specific composite material referred to as GP-L45425E7K available from General Plastics & Rubber Company, Inc. Alternatively, structural phenolics available from commercial suppliers may be used.

Tools 10 were built according to the embodiments of FIGS. 1 through 3 and were tested. Prior art tools that were equivalent, except for not having the split cone extrusion limiters 80, 82, 80', 82' and the retaining rings 84, 84' had been tested and found to have a pressure limit of about eight thousand psi at 300 degrees F. The tools according to the disclosed embodiments were found to have pressure limits of from fourteen to sixteen thousand psi at 300 degrees F. The use of split cone extrusion limiters 80, 82, 80', 82' and the retaining rings 84, 84' did not increase the force required to set the tool 10.

While the invention has been illustrated and described with reference to particular embodiments, it is apparent that various modifications and substitution of equivalents may be made within the scope of the invention as defined by the appended claims.

What we claim as our invention is:

1. Apparatus for use in a welibore, comprising:

a mandrel, a packer sealing element carried on the mandrel, the sealing element being radially expandable from a first run in diameter to a second set diameter in response to application of axial force on the sealing element, a backup shoe carried on the mandrel proximate the sealing element, the backup shoe comprising a plurality of segments, adapted to couple axial force to the sealing element, and adapted to expand radially to the second diameter, and an extrusion limiting assembly for resisting extrusion of the sealing element though gaps between segments of the backup shoe comprising;

a first split cone extrusion limiter comprising two half cones carried on the mandrel between the backup shoe and the packer sealing element, and a solid retaining ring carried on the mandrel between the split cone extrusion limiter and the packer sealing element, wherein the solid retaining ring comprises a first section that has an essentially flat disk shape, a second section that is adjacent to the first section and has a conical shape, and a third section that is adjacent to the second section and is essentially cylindrical.

2. The apparatus of claim 1, further comprising: a second split cone extrusion limiter comprising two half cones carried on the mandrel between the backup shoe and the packer sealing element.

3. The apparatus of claim 2, wherein the first and second split cone extrusion limiters are positioned so that each covers gaps in the other.

4. The apparatus of claim 1, wherein the split cone extrusion limiter comprises non-metallic material.

5. The apparatus of claim 4, wherein the split cone extrusion limiter comprises a composite material.

6. The apparatus of claim 5, wherein the split cone extrusion limiter comprises glass fiber reinforced polymer.

7. The apparatus of claim 1, wherein the solid retaining ring comprises PTFE.

8. The apparatus of claim 1, wherein the first section remains essentially in contact with the mandrel when the packer element is expanded to the set diameter, and wherein the third section expands to the set diameter when the packer element is expanded to the set diameter.

9. The apparatus of claim 1, wherein the first split cone extrusion limiter slides along the outer surface of the retaining ring when the packer element is expanded to the set diameter.

10. The apparatus of claim 1, wherein the angle between the first split cone extrusion limiter and the mandrel in the first run in diameter is essentially the same as the angle between the first split cone extrusion limiter and the mandrel in the second set diameter.

11. The apparatus of claim 1, wherein the apparatus has a pressure limit of about 14,000 psi at 300° F.

12. Apparatus for use in a wellbore, comprising:

a mandrel, a packer sealing element carried on the mandrel, the sealing element being radially expandable from a first run in diameter to a second set diameter in response to application of axial force on the sealing element, a backup shoe carried on the mandrel proximate the sealing element, the backup shoe comprising a plurality of segments, adapted to couple axial force to the sealing element, and adapted to expand radially to the second diameter, and an extrusion limiting assembly for resisting extrusion of the sealing element through gaps between segments of the backup shoe comprising;

first and second split cone extrusion limiters each comprising two half cones carried on the mandrel between the backup shoe and the packer sealing element; and a solid retaining ring carried on the mandrel between the first and second split cone extrusion limiters and the packer sealing element, wherein the retaining ring seals any gaps between the first and second split cone extrusion limiters when the packer sealing element is expanded to the second set diameter.

13. The apparatus of claim 12, wherein the first and second split cone extrusion limiters are positioned so that each covers gaps in the other.

14. The apparatus of claim 12, wherein the first and second split cone extrusion limiters comprise non-metallic material.

15. The apparatus of claim 12, wherein the first and second split cone extrusion limiters comprise composite material.

16. The apparatus of claim 12, wherein the first and second split cone extrusion limiters comprise glass fiber reinforced polymer.

17. The apparatus of claim 12, further comprising a releasable coupling between the two half cones, the releasable coupling adapted to release in response to application of axial force to the packer sealing element.

18. The apparatus of claim 12, wherein the inner diameters of the first and second split cone extrusion limiters are radially displaced from the mandrel when the packer element is expanded to the set diameter.

19. In a downhole tool having a packer sealing element carried on a mandrel and a segmented backup shoe carried on the mandrel and adapted to couple axial force to the sealing element and to expand radially as the sealing element expands radially in response to the axial force, a method for resisting extrusion of the packer sealing element through gaps between segments of the backup shoe, comprising:

providing first and second split cone extrusion limiters each comprising two half cones on the mandrel between the backup shoe and the packer sealing element; and providing a solid retaining ring on the mandrel between the first and second split cone extrusion limiters and the packer sealing element, wherein a first section of the solid retaining ring remains essentially in contact with the mandrel when the packer sealing element is expanded, and wherein a second section of the solid retaining ring expands to substantially the same diameter as the packer sealing element when the packer sealing element is expanded.

20. The method of claim 19, further comprising positioning the first and second split cone extrusion limiters so that each covers gaps in the other.

21. The method of claim 20, further comprising positioning the first and second split cone extrusion limiters so that gaps in the first are positioned about ninety degrees from gaps in the second.

22. The method of claim 19, further comprising making each split cone extrusion limiter by forming a continuous cone and cutting two gaps from an outer edge of the cone to a point proximate an inner edge of the cone, thereby forming a releasable attachment between the two half cones.

* * * * *